United States Patent [19]

Crooks

[11] 4,271,645

[45] Jun. 9, 1981

[54] BUILDING CONSTRUCTION

[76] Inventor: Melvin L. Crooks, 1201 W. Church St., Champaign, Ill. 61820

[21] Appl. No.: 89,256

[22] Filed: Oct. 29, 1979

Related U.S. Application Data

[63] Continuation-in-part of Ser. No. 903,816, May 8, 1978, Pat. No. 4,182,086.

[51] Int. Cl.[3] ..... E04B 1/32; A63H 33/12

[52] U.S. Cl. ..... 52/81; 52/DIG. 10; 52/309.4; 46/31

[58] Field of Search ..... 52/80, 81, DIG. 10; 46/30

[56] References Cited

U.S. PATENT DOCUMENTS

| | | | |
|---|---|---|---|
| 3,987,580 | 10/1976 | Ausnit | 52/DIG. 10 X |
| 4,115,963 | 9/1978 | Lubov | 52/81 |

FOREIGN PATENT DOCUMENTS

| | | | |
|---|---|---|---|
| 772048 | 10/1934 | France | 52/DIG. 10 |
| 1378942 | 1/1975 | United Kingdom | 46/30 |

*Primary Examiner*—Carl D. Friedman

*Attorney, Agent, or Firm*—Marshall A. Burmeister; Foster York; Francois N. Palmatier

[57] ABSTRACT

A framework for a building or other hollow object utilizing a plurality of basic building elements which are interconnected together in which each of the elements is constructed of a sheet of bendable resilient material which has a substantially flat permanent set, and each sheet is provided with three pairs of equally spaced apertures for interconnecting the building elements, each pair of connection apertures defining an axis which extends between the connection apertures, and the axes between the three pairs of connecting apertures intersecting at angles of 60° to form an equilateral triangle centrally of the sheet, the sheets being interconnected by pins extending through apertures to form a hollow body. Four embodiments are disclosed, one in which legs extend from the central triangle portion, and two embodiments in which a six-sided sheet forms the basic building element. In the fourth embodiment, a basic building element is disclosed which embodies a plurality of portions corresponding to the six-sided forms in a single element.

10 Claims, 6 Drawing Figures

BUILDING CONSTRUCTION

This application is a continuation-in-part of application Ser. No. 903,816 of the present inventor filed May 8, 1978 entitled BUILDING CONSTRUCTION OF A-SHAPED ELEMENTS, now U.S. Pat. No. 4,182,086.

The present invention relates generally to frameworks suitable for use as buildings, toys, lamp enclosures, and the like, and it more particularly relates to frameworks which include a group of basic elements connected together to enable the framework to assume various different desired shapes.

In the inventor's prior application Ser. No. 903,816, the inventor has disclosed frameworks formed by interconnecting A-shaped basic building elements, these frameworks being generally in the form of domes or modifications thereof. The frameworks can assume shapes suitable for buildings, swimming pool covers, silos, and other shapes, some of which are unique. The basic building elements disclosed in that application utilize three straight elongated strips which are connected together by bolts or rivets to form a central equilateral triangle and outwardly extending pairs of legs from each of the corners of the triangle.

The inventor has developed certain improvements on the framework disclosed in application Ser. No. 903,816. One of the objects of the improvements is to reduce the number of fastening elements necessary in assembling the framework. In addition, it is an object of the present invention to provide basic elements which may be more readily fabricated, such as by a stamping process or a molding process. In addition, it is an object of the present invention to provide basic building elements which will provide increased rigidity.

The basic building elements of application Ser. No. 903,816 are open and require a covering or screen to provide a closed structure. It is an object of the present invention to provide a frame constructed of basic building elements which provides at least a partially closed structure.

It is a further object of the present invention to provide an enclosure suitable for a lamp which can be colorful and artistically pleasing.

The present invention provides a framework for a building or other hollow object utilizing a plurality of basic building elements which are interconnected together in which each of the elements is constructed of a sheet of bendable resilient material which has a substantially flat permanent set. Each sheet is provided with three pairs of equally spaced connection points, which may be apertures, and each pair of connection points defines an axis which extends between the connection points. The axes of the three pairs of connection points intersect at angles of 60° to form an equilateral triangle centrally of the sheet. A plurality of sheets are interconnected by fastening means functioning at the connection points, such as pins extending through apertures, to form a hollow object.

Two separate embodiments of the present invention are set forth. In one embodiment, the sheets are provided with two groups of three edges, an edge of the first group being disposed between edges of the second group, and the edtes joined at angles disposed outwardly of the connection points to provide a six-sided sheet which serves as a basic building element. Such building elements may be interconnected forming a partially closed structure without any cover.

In a second embodiment, the basic building element comprises a sheet in the form of an equilateral triangle with three pairs of legs extending outwardly therefrom, one pair of legs extending from opposite sides of the triangle along each edge thereof, and the connecting points being disposed on the legs adjacent to the extremity thereof.

The present invention may be more fully described in connection with the drawings, in which.

Figure 1:
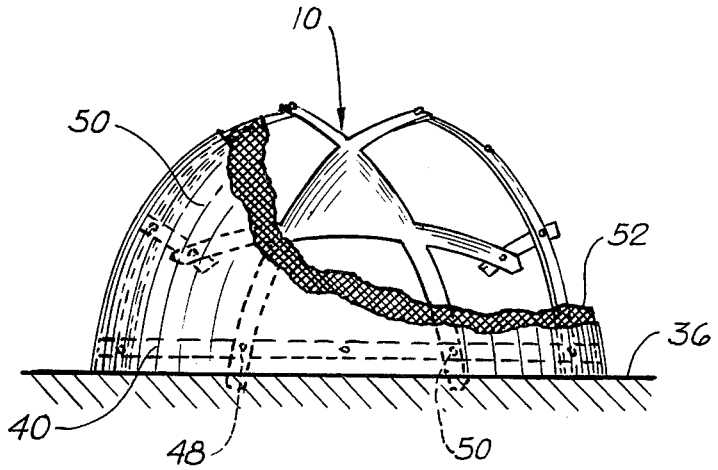
FIG. 1 is an isometric view of a structure constructed in accordance with the teachings of the present invention.
Figure 2:
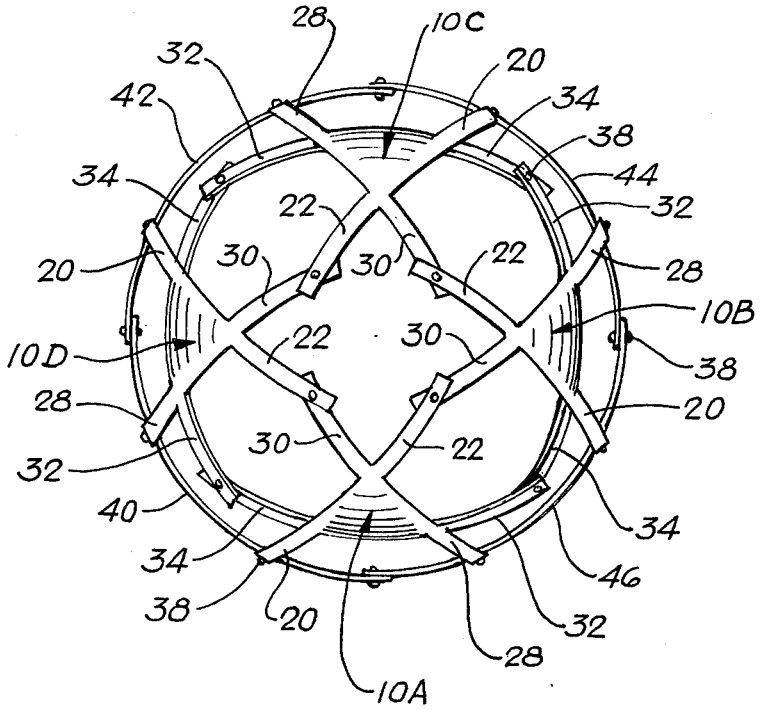
FIG. 2 is a plan view of the structure of FIG. 1.
Figure 3:
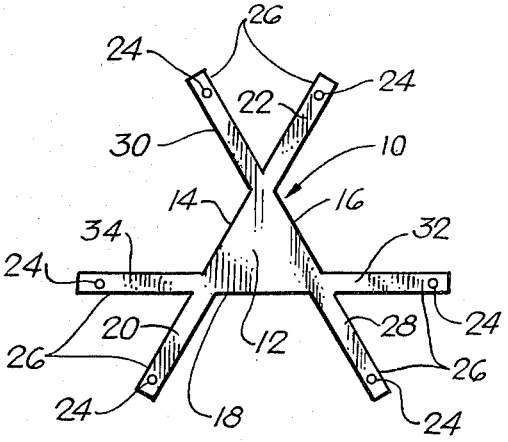
FIG. 3 is a plan view of a building element utilized in FIGS. 1 and 2.

In the embodiment of FIGS. 1 and 2, a plurality of basic building elements 10 according to the present invention are utilized to construct a semi-spherical dome. The basic building element 10 is illustrated in FIG. 3, and is fabricated from a thin sheet of material that has a permanent flat set and resilience to return to that set. Centrally of the basic building element is a portion 12 with a configuration of an equilateral triangle, that is, three sides 14, 16 and 18 disposed at 60° angles relative to each other and of equal length. A pair of elongated leg portions 20 and 22 extend outwardly from the triangular portion 12 in alignment with the edge 14. The leg portions 20 and 22 are of equal length, and an aperture 24 is disposed in each of the leg portions near the ends thereof opposite the triangular portion 12, the apertures 24 being spaced from the triangular portion 12 by the same distance in each of the legs 20 and 22, and the apertures form connection points for interconnecting the legs 20 and 22 to other basic building elements. The connection points may constitute other forms of connection elements, such as a region for spot welding or a peg and pin construction or the like. It will be noted that one edge 26 of each of the legs 20 and 22 is in alignment with the side 14 of the triangular portion 12.

In like manner, a second pair of elongated leg portions 28 and 30 extend outwardly from the triangular portion 12 of the building element 10, and the second pair of leg portions is aligned with the side 16 of the triangular portion 12. The leg portions 28 and 30 also have an edge 26 which is in alignment with the side 16 of the triangular portion of the building element 10. Apertures 24 are disposed in each of the leg portions 28 and 30 to form connection points, and the apertures 24 are spaced from the triangular portion 12 by the same distance the apertures 24 of the leg portions 20 and 22 are spaced from the triangular portion 12.

A third pair of elongated leg portions 32 and 34 extend outwardly from the triangular portion 12 with their axes of elongation parallel to the side 18. The leg portions 32 and 34 also have edges 26 which are disposed in alignment with the side 18 of the triangular portion 12, and the leg portions 32 and 34 are provided with apertures 24 adjacent to their ends opposite the triangular portion to form connecting points. The apertures 24 are disposed at the same distance from the triangular portion 12 as the apertures 24 of the first and second pair of leg portions.

It will be recognized that the basic building element of FIG. 3 is an improvement over the building element of the applicant's application Ser. No. 903,816 which utilizes three separate strips secured together through apertures to form a triangular central portion. The building element of FIG. 3 requires no connecting elements to interconnect separate strips, and hence avoids the weakening effect of positioning pins through apertures. In addition, the building element of FIG. 3 requires no operation to interconnect three separate strips, thereby reducing assembling time and cost. Further, the use of separate strips requires an interlinking of the strips, that is, none of the strips are naturally exactly of the same plane as is the case of the building element of FIG. 3 which is formed of a flat sheet of material.

The flat sheet of material may be selected of a wide variety of materials, such as plastic, metal, paper, plywood, particle board, Bakelite, reinforced fiberglass or the like. The selection of the material depends upon the ultimate use of the building element. If the building element is to be utilized as a portion of a sphere for enclosing a lamp, for example, the materials of the building element should be transparent. In such cases where strength is not the object, the materials of the building element may constitute paper, or thin sheets of plastic. If the building element is to be used exposed to the elements, the use of plastic, fiberglass, or plywood is desirable.

FIG. 1 shows a plurality of building elements 10 assembled to form a semi-sphere which rests upon a surface 36. As indicated in FIG. 2, there are four such building elements designated 10A, 10B, 10C and 10D. The leg portion 32 of the building element 10A is mounted on the leg portion 34 of the building element 10B, and the leg portion 32 of the building element 10B is mounted on the leg portion 34 of the building element 10C. In like manner, the leg portion 32 of the building element 10C is mounted on the leg portion 34 of the building element 10D, and the leg portion 32 of the building element 10D is mounted on the leg portion 34 of the building element 10A. In each case, the leg portions are mounted on each other by means of pins 38 which extend through the apertures 24 in adjacent leg portions.

Also, the leg portion 22 of building element 10A is mounted on the leg portion 30 of building element 10B, and the leg portion 22 of building element 10B is mounted on the leg portion 30 of building element 10C. In like manner, the leg portion 22 of building element 10C is mounted on the leg portion 30 of building element 10D, and the leg portion 22 of building element 10D is mounted on the leg portion 30 of building element 10A.

The legs 20 and 28 of each of the building elements 10A, 10B, 10C and 10D are anchored on the surface 36, preferably by embedding the legs 20 and 28 in concrete, as shown in FIG. 1. In addition, support strips 40, 42, 44, and 46 are mounted adjacent to the surface 36 and interconnected at their ends by means of pins 38 to form a circular configuration. The support strips are provided with apertures 48 which are aligned with the apertures 24 in the leg portions 20 of the building elements 10A, 10B, 10C and 10D, and pins 38 mount the leg portions 20 on the circular ring formed by the strips 40, 42, 44 and 46. In like manner, the strips are provided with apertures 50 which are aligned with the apertures 24 in the leg portions 28 of the building elements 10A, 10B, 10C and 10D, and pins 38 interconnect the ring formed by the strips 40, 42, 44 and 46 with the leg portions 28 of the building elements 10A, 10B, 10C and 10D.

As illustrated in FIG. 1, the structure formed by means of the basic building elements 10A, 10B, 10C and 10D is completed by a wire mesh 52 which extends over the entire structure and a layer of material 54 placed upon the wire mesh 52. The layer of material may be concrete, plastic, and is preferably closed cellular foam plastic, such as polyurethane, which will be water tight and light and further provide thermal insulation.

Figure 4:
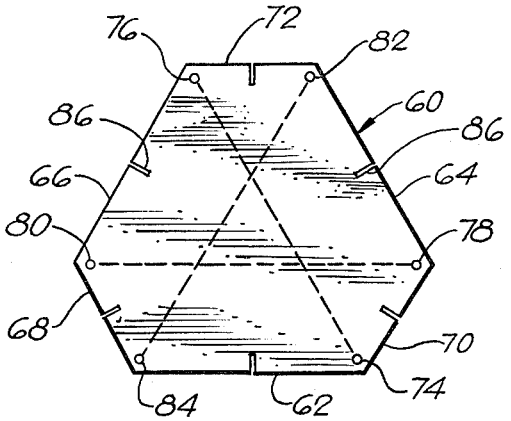
FIG. 4 is a plan view of another building element which constitutes another embodiment of the present invention.
Figure 5:
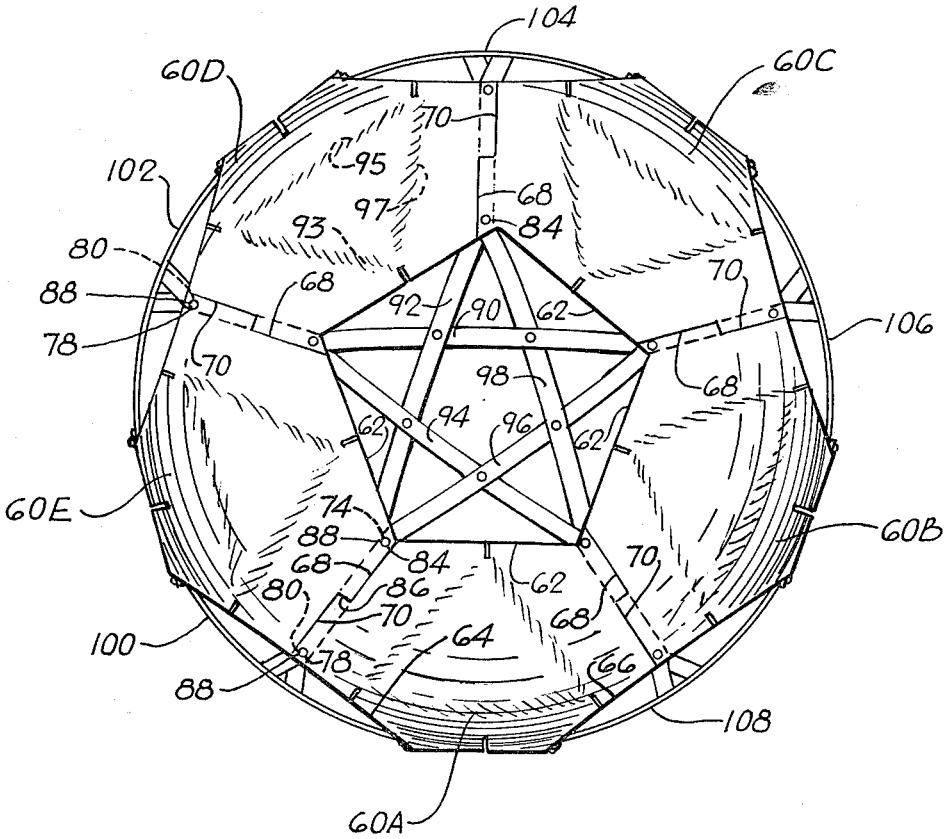
FIG. 5 is an isometric view of a substantially spherical structure constructed of building elements as set forth in FIG. 4.

FIGS. 4 and 5 illustrate another embodiment of the present invention. The basic building elements as utilized in FIGS. 4 and 5 are in the form of a flat six-sided sheet, as best illustrated in FIG. 4. This building element, designated 60, has two groups of sides, the one group being relatively long and designated 62, 64, and 66, and the sides of the other group being relatively short and designated 68, 70, and 72. Each of the sides of the first group extends to a side of the second group, and each of the sides of the first group is parallel to and spaced from a side of the second group.

The six-sided flat sheet which forms a building element 60 is provided with three pairs of connecting points, the connecting points of each pair being on opposite sides of the building element and disposed adjacent to the junction of a side of the first group and a side of the second group. In the embodiment illustrated, the connecting points are in the form of apertures, and the first pair of apertures are designated 74 and 76, the aperture 74 being disposed adjacent to the angular junction formed by the side 62 and the side 70, and the aperture 76 being disposed adjacent to the angular junction formed between the sides 66 and 72. In like manner, an aperture 78 is disposed adjacent to the angular junction between the side 64 and the side 70, and the aperture 78 forms a second pair of apertures with an aperture 80 disposed adjacent to the angular junction between the sides 66 and 68. Further, an aperture 82 is disposed adjacent to the angular junction between the sides 64 and 72, and the aperture forms a third pair of apertures with an aperture 84 disposed adjacent to the angular junction between the sides 62 and 68. The apertures in each pair define an axis, the axes being shown in dashed lines in FIG. 4, and it will be noted that the axes intersect in an equilateral triangle centrally of the building element 60.

FIG. 5 illustrates a plan view of a semi-sphere constructed of a plurality of basic building elements 60. In FIG. 5, the building elements are designated as 60A, 60B, 60C, 60D and 60E. Each of the building elements 60A, 60B, 60C, 60D and 60E are constructed in the manner of FIG. 4. It will be noted in FIG. 4 that each side 62, 64, 66, 68, 70 and 72 is provided with a slot 86 which extends normally from the center of the side into the sheet which forms the building element 60. As a result, adjacent building elements 60 may be mounted with the slots of adjacent sides engaging each other to provide a central support for the building element side. This construction is shown in greater detail in FIG. 5, although it is to be understood that the building elements may be mounted on each other without the use of slots, with some sacrifice in rigidity.

As illustrated in FIG. 5, the building element 60A has its side 70 mounted on the side 68 of building element 60E by means of a pin 88 disposed in the aperture 74 of building element 60A and in the aperture 84 of building element 60E. In like manner, a pin 88 is disposed in the aperture 78 of building element 60A and the aperture 80 of building element 60E. As illustrated, the side 70 of building element 60A overlaps the side 68 of building element 60E from the aperture 78 of building element 60A to the slot 86, and vice versa from the slot 86 to the apertures 74. As a result, the mating sides 68 and 70 are held securely in position with a center locking region.

In a similar manner, the side 68 of building element 60A is mounted on the side 70 of building element 60B, and the side 68 of building element 60B is mounted on the side 70 of building element 60C. In like manner, the side 68 of building element 60C is mounted on the side 70 of building element 60D, and the side 68 of building element 60D is mounted on the side 70 of building element 60E. In this manner, a complete circular surface of revolution is formed leaving a five-sided octagon open at the top. As illustrated in the figures, five strips designated 90, 92, 94, 96, and 98 are utilized in a star shaped pattern to support the open top, and partially close the same. If the structure is to be utilized as a lamp, the five strips 90, 92, 94, 96 and 98 may be utilized to support the cord and socket structure, or a support for handing purposes.

The strips 90, 92, 94 and 96 are selected to have the same length as the axes between apertures 74 and 76 of the building element 60, and this length is shorter than the distance between the apertures 84 of building element 60E to aperture 84 of building element 60D. As a result, the building elements 60A, 60B, 60C, 60D and 60E pucker or bend along lines 93, 95 and 97. This puckering effect adds stability or rigidity to the structure.

In order to complete the structure and to support the lower edges of the structure, additional strips 100, 102, 104, 106, and 108 are utilized to provide a supporting ring. The strips 100, 102, 104, 106 and 108 are secured together by pins, which may be screws and nuts as disclosed in applicant's prior application, and the ring formed of these strips is mounted on the basic building elements 60A, 60B, 60C, 60D, and 60E through the apertures 76 and 82.

It will be recognized that other type structures may be fabricated in the manner of applicant's prior application Ser. No. 903,816. For example, the structure of FIG. 5 may be repeated, with or without the strips 100, 102, 104, 106 and 108 to produce a sphere. Also, more basic building elements 60 may be employed than the five illustrated in FIG. 5 to produce a larger object. Further, different shaped objects will be obtained by joining sides 70 and 72 of the basic building elements illustrated in FIG. 4, or by joining the longer sides 64 and 62, or 64 and 66, or 62 and 66. All such combinations may be utilized to produce a structure of the desired shape.

Figure 6:
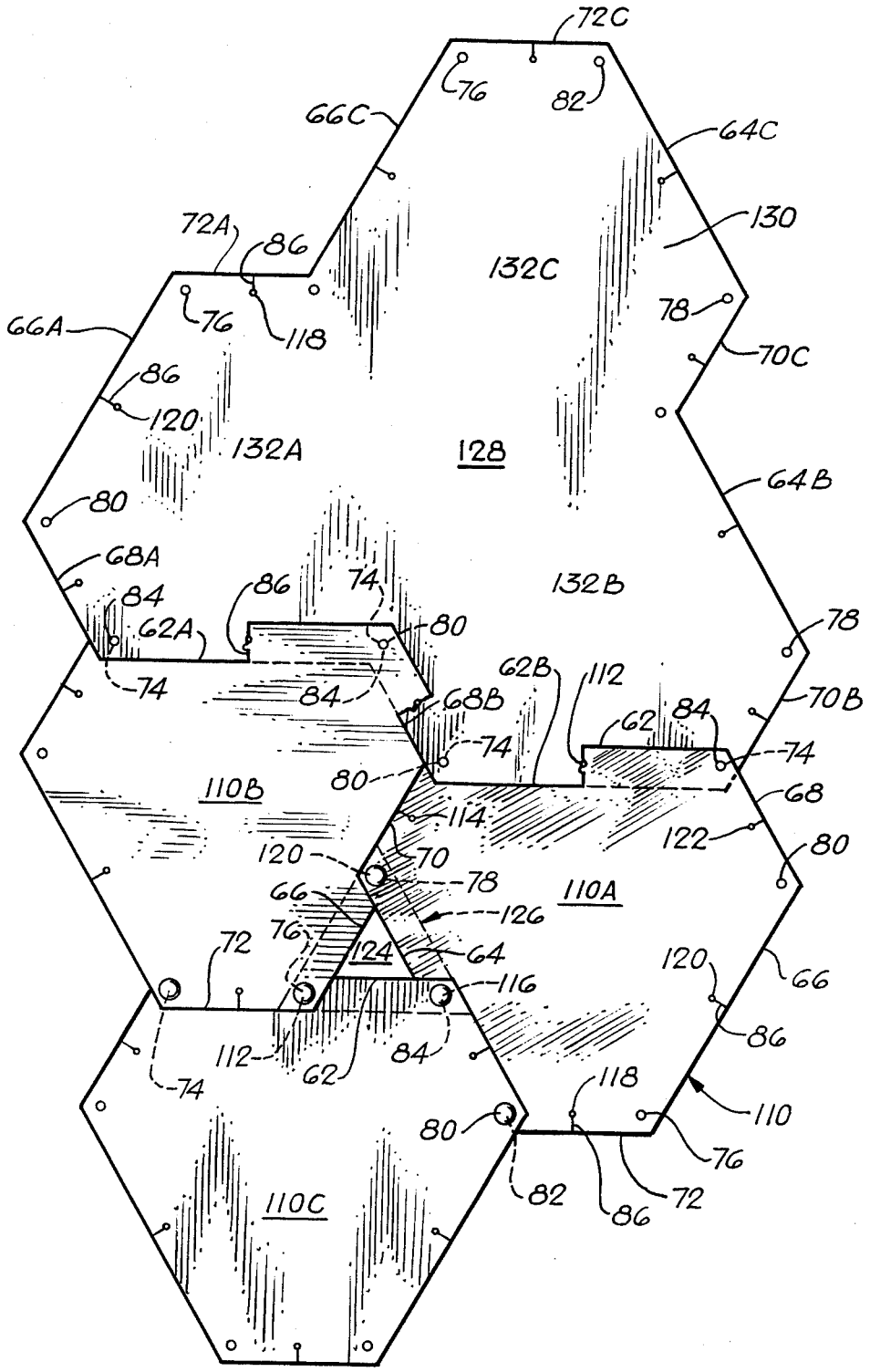
FIG. 6 is a plan view of a partially assembled structure utilizing two building elements constituting still other embodiments of the present invention.

It will be recognized from observing FIG. 4, that the building element 60 is essentially an isosceles triangle with the three corners removed to form the sides 68, 70 and 72. Accordingly, the short sides 68, 70 and 72 are exactly one half the length of the long sides 62, 64, and 66. FIG. 6 illustrates a modified form of building element 110 and further illustrates three such building elements 110A, 110B and 110C connected together. The building elements 110 are all identical to the building element 60 of FIG. 4 except that a connection point is disposed inwardly of each of the slots 86 in alignment with the adjacent connection points at the corner of the element. Accordingly, the same reference numerals have been used to designate the sides and connection points of the building elements 110 as used in FIG. 4. Side 62 has a central connection point 112 located centrally between and on axis with the connection points 74 and 84. Side 70 has a connection point 114 located centrally and in alignment with the axis between connection points 74 and 78. Side 64 has a connection point 116 located centrally and on axis between the connection points 78 and 82. Side 72 has a connection point 118 located centrally and on axis between the connection points 82 and 76. Side 66 has a connection point 120 located centrally and on axis between the connection points 76 and 80, and side 68 has a connection point 122 located centrally and on axis between the connection points 80 and 84. In all cases, the connection points are in the form of apertures, and pins are utilized as a connecting element.

FIG. 6 illustrates the short side 70 of building element 110A mounted between the connection point 120 and connection point 80 of building element 110D, the entire side 70 being disposed above the side 66 of building element 110B. In like manner, the side 62 of building element 110C is mounted on the side 72 of building element 110B by means of pins extending through the apertures 82 and 76 of building element 110B and apertures 74 and 112 of building element 110C. Building element 110C is also connected on building element 110A by means of pins extending through the apertures 116 and 82 of building element 110A and apertures 84 and 80 of building element 110C. Accordingly, it is to be noted that building elements 110 may be connected together, not only with their long sides interconnected, or their short sides interconnected, as is the case of the building element 60, but also with a short side connected to a long side. When the building elements 110 are interconnected with a short side connected to a long side, the building elements 110 cover a larger proportion of the total area of the structure created and the voids as represented by the triangular opening 124 are significantly smaller. The voids, as illustrated in FIG. 6 may be covered by triangular panels designated 126 positioned behind the building elements 110A, 110B, 110C, and secured by the pins extending through the apertures 78, 120, 76, 112, and 84, 116 to provide a complete cover.

The inventor has also found that clusters of three building elements 110 secured together in the manner illustrated in FIG. 6 may themselves form a building block, designated 128 in FIG. 6, and these elements may be interconnected with like elements or clusters of building elements 60 or 110 to produce the desired structure. The building element 128 consists of a single sheet of material which is resilient and has a flat permanent fix, the sheet being designated 130. The perimeter of the sheet 130 is identical to the perimeter of the cluster of building elements 110A, 110B, 110C, but the building element 128 eliminates the overlapping of segments and the internal void 124.

The building element 128 has a portion 132A which corresponds to the building element 110A. In like manner, the building element 128 has a portion 132B which corresponds to the building element 110B and a portion 132C which corresponds to the building element 110C.

The portion 132A has a side 62A which corresponds to the side 62 of building element 110A and has apertures 84 and 74 and a central slot 86. The side 62A of the building element 128 is mounted on the side 62 of building element 110B by means of pins extending through the apertures 84 and 74 of building element 128 and apertures 74 and 84 of building 110B, respectively. The portion 132A of building element 128 also has a side 68A which corresponds and is identical to side 68 of the building element 110, a side 66A which corresponds to the side 66 of the building element 110 and is identical thereto. The portion 132A of building element 128 also has a side 72A which corresponds and is identical to the side 72 of the building element 110.

Aperatures 76 and 82A are positioned adjacent to the side 72A of the building element 128 and correspond with the apertures 76 and 82 of the building element 110. The portion 132C of the building element 128 has a side 66C which extends from the side 72A and corresponds to the side 66 of the building element 110. The aperture 82A is disposed at one end of the side 66C, and the aperture 76 is disposed at the opposite end thereof. Hence the apertures 82A and 76 correspond with the apertures 80 and 76 of building element 110. Portion 132C of building element 128 has a side 72C which corresponds to the side 72 of building element 110, and also a side 64C which corresponds to the side 64 of building element 110. Apertures 82 and 78 are disposed at opposite ends of the side 74C. In addition, portion 132C of the building element 128 has a side 70C which extends from the side 64C and corresponds to the side 70 of building element 110. An aperture 74C is disposed adjacent to one end of the side 70C, and the aperture 78 is disposed at the opposite end.

The side 70C extends to a side 64B of the portion 132B of the building element 128, and the side 62B has aperture 74C at one end thereof and a second aperture 78 at the opposite end thereof. A side 70B extends from the side 64B, and has an aperture 74 at the end thereof opposite the aperture 78. Portion 132B is completed by a side 62B which extends from the side 70B and corresponds to the side 62 of the building element 110, and a side 68B which extends from the side 64B to the side 62A. The side 68B corresponds to the side 68 of the building element 110 and completes the periphery of the building element 128. The portion 132B of the building element 128 has one aperture 74 at one end of the side 62B, and another aperture 84 at the opposite end thereof. Side 68B has the aperture 84 at one end thereof and an aperture 80 at the opposite end thereof. As illustrated in FIG. 6, the portion 132B of building element 132C is secured on building element 110A and the portion 132A of building element 128 is secured on the building element 110B by pins extending through the aligned apertures 74 and 84 of the respective elements.

The fact that the building elements 110A, 110B, and 110C are collectively equivalent to the building element 128 when interconnected in the manner indicated illustrates the fact that a plurality of building elements 128 may be interconnected to produce a substantially continuous wall, and the wall may be bent upon itself in the manner of building elements 60, as illustrated in FIG. 5 to produce solid objects.

Accordingly, those skilled in the art will readily undertake the construction of objects of different sizes and shapes than those here set forth, and may provide building elements of different construction within the scope of the present invention. If is therefore intended that that scope of the present invention be not limited by the foregoing disclosure, but rather only by the appended claims.

The invention claimed is:

1. A framework for a hollow solid object comprising a plurality of basic building elements interconnected together, each of said elements being constructed of bendable resilient sheet material having a flat set and having three pairs of equally spaced connection points, each pair of connection points defining an axis extending therebetween, each of the axes of the pairs of connecting points intersecting the axes of both of the other pairs of connecting points at an angle of 60° and forming an equilateral triangle centrally of the element, the axis of each pair intersecting the axis of each of the other pairs at points spaced from the mid point between the connecting points of said axis by equal distances, a plurality of fastening means disposed at connecting points of the building elements, said fastening means securing each of said basic building elements on a plurality of other basic building elements.

2. A framework for a hollow solid object comprising the combination of claim 1, wherein a basic building element comprises a thin solid sheet having six edges arranged in two groups of three edges each, the edges of each group being of the same length and the edges of the first group being longer than the edges of the second group, each edge of the first group being disposed between edges of the second group and joining the adjacent edge of the second group at an angle, each of the connection points being disposed adjacent to the junction of an edge of the first group with an edge of the second group.

3. A framework for a hollow solid object comprising the combination of claim 2 wherein two of the basic building elements have a slot extending inwardly from the center of the edges of the first group thereof perpendicularly to the edges thereof, and an edge of the first group of one of said basic building elements is disposed in overlapping relation with the edge of the first group of the other of said basic building elements with the connection points at the ends of said overlapping edges aligned with each other, and the slot of one of said basic building elements engaging the slot of the other of said basic building elements.

4. A framework for a hollow solid object comprising the combination of claim 2 wherein two of the basic building elements have a slot extending inwardly from the center of each of the edges of the second group thereof perpendicularly to the edges thereof, and an edge of the second group of one of said basic building elements is disposed in overlapping relation with the edge of the second group of the other of said building elements with the connection points at the ends of said overlapping edges aligned with each other, and the slot of one of said basic building elements engaging the slot of the other of said basic building elements.

5. A framework for a hollow solid object comprising the combination of claim 2 wherein an edge of the first group is provided with a center connection point located on the axis between the connection points adjacent to the ends of said edge, the distance between said center connection point and the connection points at the ends of said edge being equal to the distance between connection points adjacent to the edges of the second group.

6. A framework for a hollow solid object comprising a first basic building element and a second basic building element according to claim 2, each of said building elements having an edge of the first group provided with a center connection point located on the axis between the connection points adjacent to the ends of said edge, the distance between said center connection point and the connection points at the ends of said edge being equal to the distance between connection points adjacent to the edges of the second group, one of the edges of the second group of the first basic building element being connected on said edge of the second basic building element at the center connection points of said edge and a connection point adjacent to one end of said edge.

7. A framework for a hollow solid object comprising the combination of claim 6 in combination with a third basic building element identical to the first and second basic building elements, said third basic building element being connected on the second basic building element with an edge of the second group of said second building element connected at the connection points adjacent to said edge of the third basic building element, the center connection point of said edge and a connection point adjacent to one end of said edge of the third basic building element being attached to the connection point adjacent to the ends of said edge of the second group of the second building element, and said third basic building element being connected to the first basic building element, said third basic building element being connected to the first basic building element with said edge of the first group of the first basic building element connected to an edge of the second group of the third basic building element, the center connection point of said edge and a connection point adjacent to an end of said edge of the first basic building element being connected to the connection points adjacent to the ends of the edge of the second group of the third basic building element.

8. A framework for a hollow solid object comprising the combination of claim 1 wherein a basic building element comprises a thin solid sheet having an equilateral triangular portion centrally thereof with three straight edges, a first pair of legs extending outwardly from opposite sides of the triangular portion along an axis parallel to the first straight edge of the triangular portion a second pair of legs extending outwardly from opposite sides of the triangular portion along an axis parallel to the second straight edge of the triangular portion, a third pair of legs extending outwardly from opposite sides of the triangular portion along an axis parallel to the third straight edge of the triangular portion, each of the legs having one connection point located thereon and each of the connection points being located from the triangular portion by the same distance.

9. A framework for a hollow solid object comprising the combination of claim 1 wherein the connection points are apertures extending through the sheet and the fastening means comprise a plurality of pins, each pin extending through an aperture of two basic building elements.

10. A framework for a hollow solid object comprising a plurality of building elements connected to each other, at least one of said building elements comprising a sheet of resilient material having a flat set, said sheet having a first portion, a second portion and a third portion, each portion being integral with the other two portions, and three portions having a continuous perimeter consisting of two groups of interconnected straight edges, the edges of each group being of the same length and the edges of the first group being longer than the edges of the second group, the perimeter of each building element consisting of six edges of the first group separated by edges of the second group, each portion of each building element having two edges of the first group and two edges of the second group, one edge of the first group being parallel to one edge of the second group in each portion, the other two edges of each of the portions being parallel to an edge of the other group of different other portions of said building element.

* * * * *